United States Patent [19]

Christensen et al.

[11] 4,022,154

[45] May 10, 1977

[54] APPARATUS FOR CLEANING A DOCTOR BLADE

[75] Inventors: Kenneth K. Christensen, Winfield; Charles A. Uncapher, Worth, both of Ill.

[73] Assignee: Continental Can Company, Chicago, Ill.

[22] Filed: June 11, 1975

[21] Appl. No.: 585,858

[52] U.S. Cl. ..... 118/261

[51] Int. Cl.[2] ..... B05C 1/08

[58] Field of Search ..... 118/259, 413, 261, 258; 101/350, 365

[56] References Cited

UNITED STATES PATENTS

| | | | |
|---|---|---|---|
| 3,037,451 | 6/1962 | Davis | 118/261 X |
| 3,611,928 | 10/1971 | Kaneko | 118/261 X |

*Primary Examiner*—John P. McIntosh

*Attorney, Agent, or Firm*—Diller, Brown, Ramik & Wight

[57] ABSTRACT

This disclosure is directed to apparatus for periodically purging contaminants from a coating liquid during a coating operation and, more particularly, for cleaning a doctor blade of an adhesive coater, the apparatus including a container having an open bottom defining with a surface of a rotatable transfer roll and a doctor blade a gap of a predetermined size which doctors the coating liquid or adhesive to a desired thickness prior to the application thereof to an article which is to be coated, and means for periodically increasing the predetermined size of the gap and returning the increased gap size to the predetermined size whereby particles otherwise incapable of passing through the gap when of the predetermined size will pass through the gap when of the increased size to thus maintain a relatively clean bath of liquid throughout a coating operation.

4 Claims, 4 Drawing Figures

2
3
4

APPARATUS FOR CLEANING A DOCTOR BLADE

Coventional adhesive applicating machines or similar coating machines generally include a vat, tank, or similar container having an open bottom which is closed substantially entirely by a rotatable transfer roll except for a gap between a doctor blade and a surface of the transfer roll through which the coating material may pass for subsequent application to an article which is to be coated such as, for example, a moving web of paper or similar material. The gap is subject to clogging for various reasons, including atmospheric contaminants, such as small particles of dirt, dust, etc., agglomeration of the coating material, etc. It is, of course, recognized that the gap should be perfectly uniform in size and maintained free of particles or similar contaminants so that a uniform coating of the material will be applied to the transfer roll and from there deposited upon the article which is to be coated. However, during continued usage of known coating, laminating, adhesive applying, or like machines, such gaps become partially clogged in an indiscriminant fashion over the length of the doctor blade and thus the coating material exiting the gap is not of a uniform thickness with the end result being the performance of a coating operation below the optimum desired.

In keeping with the present invention, a primary object thereof is to provide a novel apparatus for periodically purging contaminants and/or agglomerates from a coating liquid (adhesive) during a coating operation through the use of means for periodically increasing the predetermined size of a gap between a lower terminal end of a doctor blade and a peripheral surface of a transfer roll and returning the increased gap size to the predetermined size whereby contaminants or other undesired material otherwise incapable of passing through the gap or collected upon the doctor blade will pass through the gap when the predetermined size is increased.

A further object of this invention is to provide a novel apparatus of the type heretofore described wherein the doctor blade is constructed of resilient material, and the gap size increasing means is operative for effecting deflection of the doctor blade between the predetermined and increased gap sizes.

Still another object of this invention is to provide a novel apparatus of the type heretofore set forth wherein the means for changing the gap size includes pivotally mounted arm means having opposite ends of which one is in contact with the doctor blade and an opposite one which is movable through a cam for pivoting the arm means and thereby vary the size of the gap.

Yet another object of this invention is to provide a novel apparatus as set forth heretofore including means for selectively adjusting the predetermined size of the gap, the last-mentioned adjusting means being thumbscrew means carried by the arm means in contact with the cam means.

IN THE DRAWINGS

Figures 1, 2:
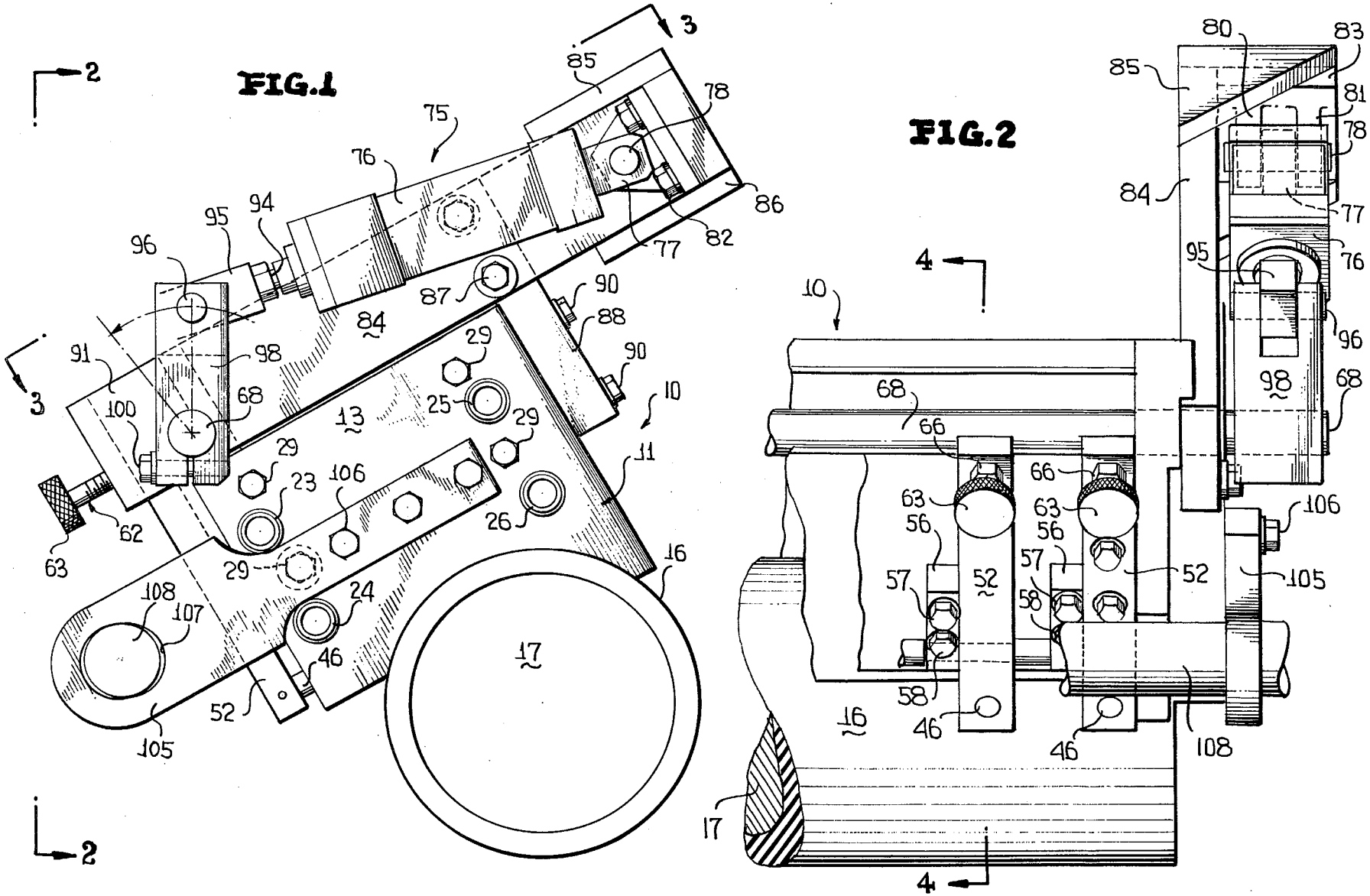
FIG. 1 is a side elevational view of a novel apparatus constructed in accordance with this invention, and illustrates a container for housing a bath of coating liquid and a pneumatic cylinder operative through a linkage mechanism for rocking a shaft operative through pivotally mounted arms for varying the size of a gap between a doctor blade and a peripheral surface of a transfer roll.
FIG. 2 is a fragmentary perspective view taken generally along line 2—2 of FIG. 1, and more clearly illustrates the details of the apparatus including thumbscrews carried by the pivotally mounted arms for selectively adjusting the size of the gap and a cam contacted by the thumbscrews for varying the size of the gap upon rocking motion being imparted to the cam.
Figure 4:
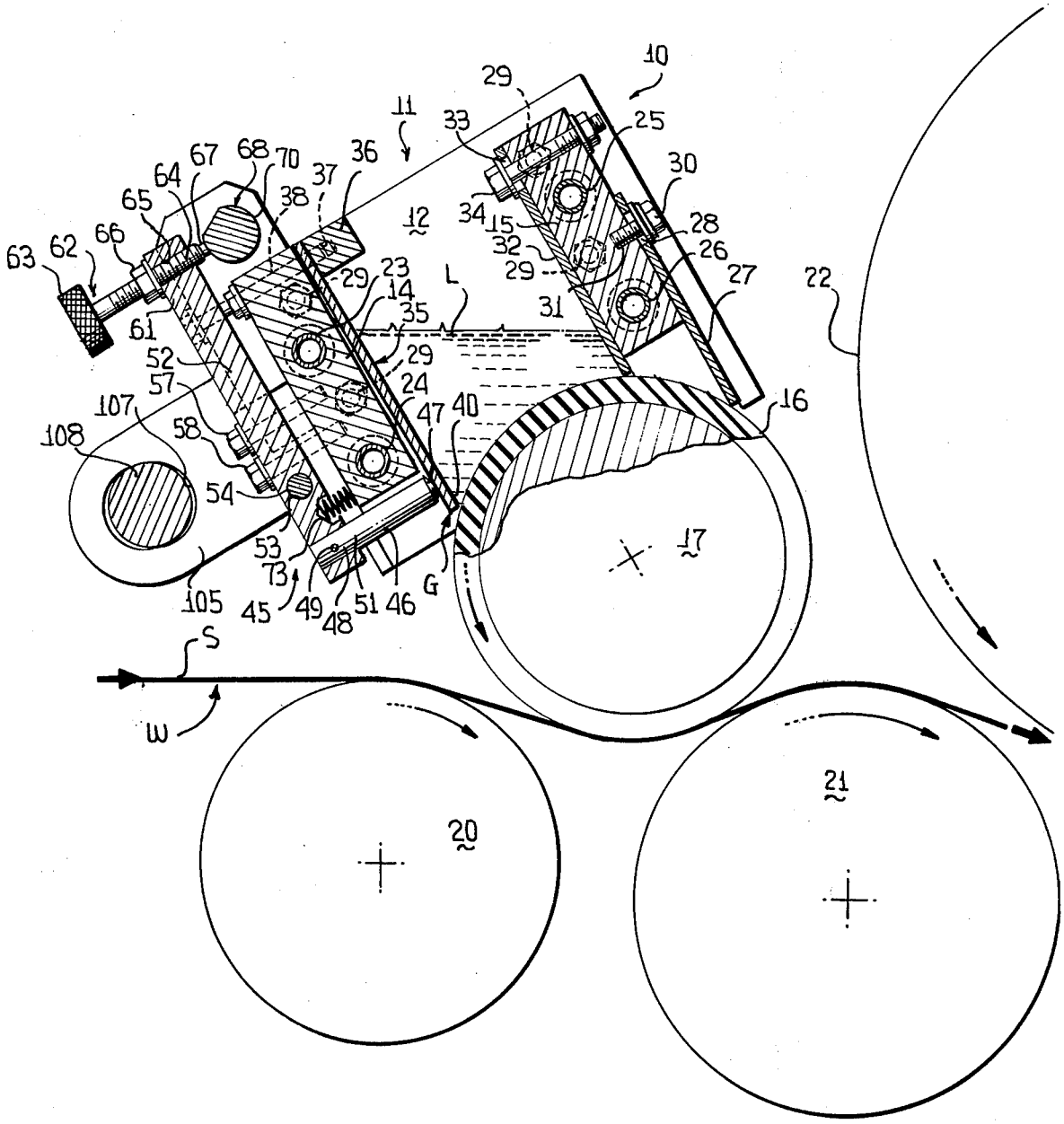

FIG. 4 is a cross sectional view taken generally along line 4—4 of FIG. 2, and more clearly illustrates details of the mounting of the doctor blade, one of a plurality of pivotally mounted arms, and the cam for pivoting the doctor blade through an adjusting thumbscrew. A novel apparatus for periodically purging contaminants from a bath of coating liquid during a coating operation is generally designated by the reference numeral 10 and includes a container 11 having opposite relatively thick end walls 12,13 and relatively thick side walls 14,15 (FIG. 4) between which is housed a bath of coating liquid L (FIG. 4) such as an adhesive. A bottom (unnumbered) of the container 11 is open, as is a top thereof, but the open bottom end is substantially closed by a contiguous peripheral surface 16 of a transfer roll 17. The transfer roll 17 is rotated counterclockwise, as viewed in FIG. 4, by a suitable drive means (not shown). During the counterclockwise rotation of the transfer roll 17 a portion of the liquid L retained by the peripheral surface 16 is transferred to an upper surface S of a web W of paper or similar material suitably conveyed from left-to-right, as viewed in FIG. 4 by rollers 20,21 toward and upon a mandrel 22 of a conventional winding machine for manufacturing fiber drums or containers.

The walls 12, 13, 14 and 15 are secured to each other by four bolts 29 (FIGS. 1 and 4). Four pipes 23–26 passing through bores (unnumbered) in the walls 14 and 15 are connected to a source of heated oil for maintaining the coating liquid L at a desired temperature which might be necessary for certain type adhesives.

An elongated plate 27 spans an exterior surface (unnumbered) of the wall 15 and includes a plurality of elongated slots 28 each of which receives a threaded fastener 30 which is received in a threaded bore 31 of the wall 15. Though only a single fastener 30, slot 28, and threaded bore 31 are illustrated, it is to be understood that a plurality of the latter three components are provided along the longitudinal length of the associated plate 27 and the wall 15 so that the plate 27 may be adjusted upwardly or downwardly, as viewed in FIG. 4.

A similar plate 32 spans the longitudinal length of the wall 15 on an inner surface (unnumbered) thereof and includes a plurality of longitudinal slots 33 through each of which passes a fastener 34 for likewise adjusting the plate 32 upwardly or downwardly, as viewed in FIG. 4. The lower terminal edge (unnumbered) of the plate 32 is preferably adjusted such that is is sufficiently close to the peripheral surface 16 of the transfer roll 17 so that the liquid L will not leak outwardly therebetween.

Doctor blade means 35 in the form of an elongated doctor blade formed of resilient metallic or similar material spans the length of the container 11 between the end walls 12,13 and is secured at an upper end (unnumbered) thereof in sandwich relationship between the wall 14 and a bar 36 having a plurality of threaded bores 37 which receive a plurality of fasteners 38 passing through bores (unnumbered) in the wall 14. The fasteners 38 are bolts suitably spaced along the length of the wall 14 and when tightened clamp the upper end (unnumbered) of the doctor blade 35 against the wall 14. A lower terminal end or edge 40 of the doctor blade 35 defines with the peripheral surface 16 of the transfer roll 17 a gap G of a predetermined size which regulates, depending upon the size thereof, the thickness of the material which is transferred from the liquid bath L upon the surface 16 of the transfer roll 17 and thus likewise controls the amount of the liquid transferred to the surface S of the web W. The gap G spans the distance between the end walls 12,13 and in practice the size thereof should be uniform throughout its length for optimum transfer and thus uniformity of thickness of the liquid L exiting the gap G upon the surface 16 of the transfer roll 17. However, in actual practice atmospheric contaminants, such as dust, small particles of dirt, agglomeration of the coating liquid L itself, etc. may cause the gap G to become partially clogged along its length thereby resulting in a variance in the thickness of the material L which exits the gap G thus partially clogged.

In accordance with this invention means, generally designated by the reference number 45, are provided for periodically purging contaminants from the area of the gap G during a transfer or coating operation by periodically increasing the predetermined size of the gap G and returning the increased gap size to the predetermined size. In FIG. 4 the gap G is illustrated being of a desired predetermined size and upon the operation of the means 45, the gap G is first increased in size and then returned to its original size whereby contaminants, particles or other material otherwise incapable of passing through the predetermined size of the gap G will pass through the enlarged or increased size thereof.

Figure 3:
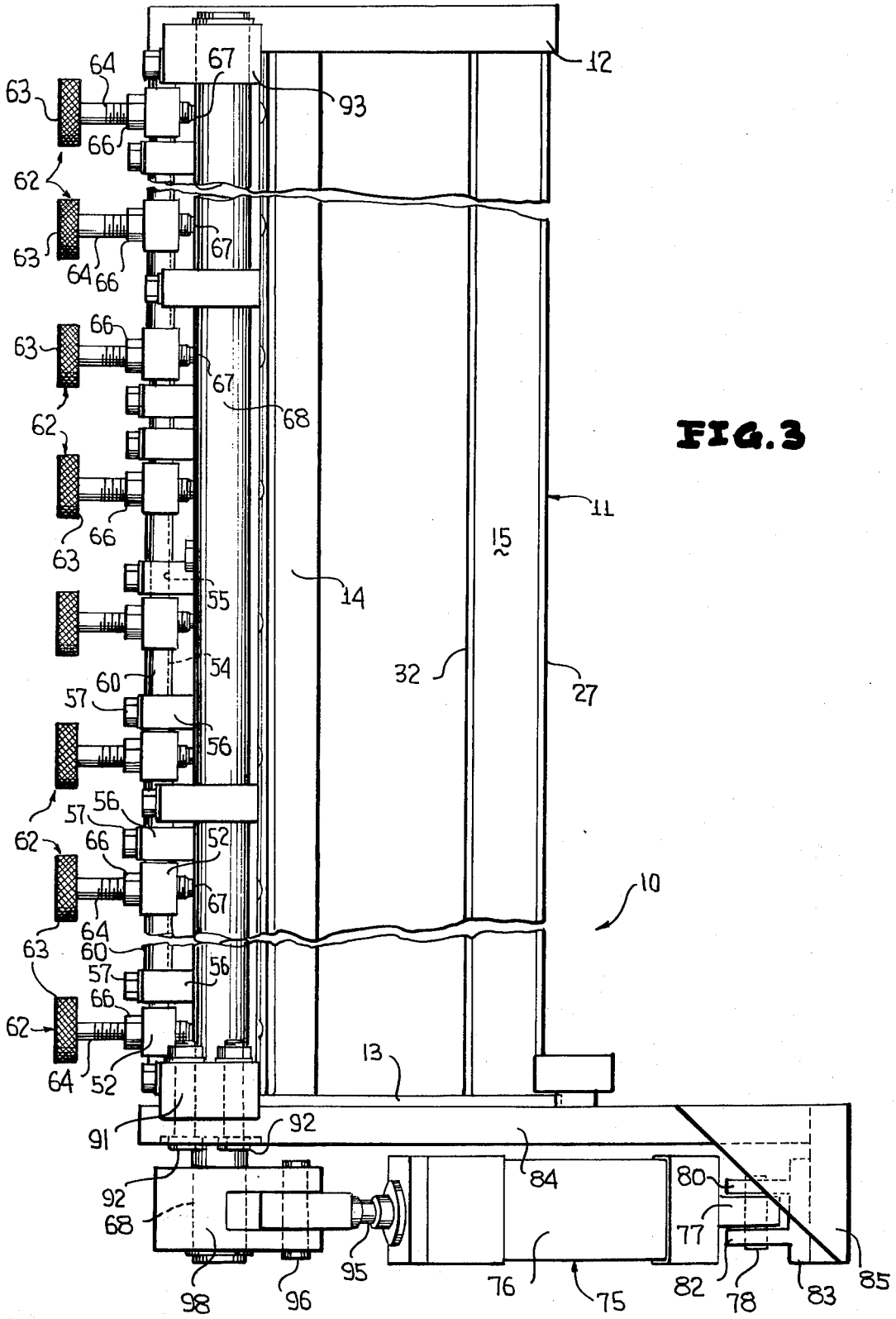
FIG. 3 is a fragmentary top plan view taken generally along line 3—3 of FIG. 1, and illustrates in further detail a plurality of thumbscrews, their associated cam, and the pneumatic or fluid cylinder for rocking the cam to vary the gap.

The means 45 includes a plurality of pins 46 (FIG. 4) each having a rounded end 47 contacting the lower terminal end portion 40 of the doctor blade 35 and an opposite end 48 secured by a pin 49 or the like to an end portion 51 of an associated arm 52. Each of the arms 52 has a bore 53 through which passes a cylindrical rod 54. The rod 54 passes through bores 55 in a plurality of plates 56 each of which is secured by a pair of screws 57,58 to the wall 14 of the container 11. Terminal ends (not shown) of the rod 54 are threaded and receive a nut to preclude endmost ones of the arms 52 from being removed therefrom or for the rod 54 from being slid outwardly of the bores 55. A plurality of tubular sleeves 60 have received therethrough the rod 55 and function as spacers to prevent the arms 52 from sliding along the rod 55 in the manner most evident from FIG. 3. For example, the second arm 52, as counted from the right in FIG. 3, is prevented from sliding to the right by the sleeve 60 to the right thereof which abuts against the first arm 56, as also counted from the right in the same Figure. In this manner, the arms 52 are maintained in desired positions along the length of the doctor blade 35 and yet are each mounted for pivotal or rocking movement about the rod 54.

Each arm 52 carries at an end 61 remote from the end 51, a thumbscrew 62 having a knurled head 63 and a threaded shank 64 which is threadedly received in a threaded bore 65. A nut 66 locks each thumbscrew 62 in a desired position to adjust the predetermined size of the gap G between the terminal end 40 of the doctor blade 35 and the peripheral surface 16 of the transfer roll 17 in a manner to be more fully described hereinafter.

A terminal end 67 (FIG. 4) of each thumbscrew 62 rests upon an elongated cam 68 having a generally cylindrical portion 70 (FIG. 4) and a flattened cam portion 71. As is most evident from FIG. 4, when the end 67 of each thumbscrew 62 rests upon the cylindrical cam portion 70, the gap G is at its smallest or minimum size whereas upon the rotation of the cam 68, such that each end 67 of each thumbscrew 62 rests against the flat cam portion 71, the gap G is increased as each arm 52 pivots about the rod 54 in a clockwise direction, as viewed in FIG. 4, under the influence of the resilient nature of the doctor blade 35, as well as a plurality of compression springs 72 (FIG. 4) which are sandwiched between the wall 14 and a bore 73 of each of the arms 52. While particles, agglomerates of the liquid L, and other contaminants might not pass through the gap G when the arms 52 are in the position shown in FIG. 4, upon the clockwise rotation, again as viewed in FIG. 4, of the arms 52, the gap G increases in size and such particles are released and pass through the gap G for subsequent transfer from the periphery 16 of the transfer roll 17 to the surface S of the web W. The time period during which the gap G is increased in size is minimal and may be varied as circumstances dictate with the criteria for the particular time period of maximum increased size of the gap G being dependent upon the time required for the undesired particles to be passed through the gap G.

The movement of the doctor blade 35 through the pivoting of the arms 52 by virtue of the rocking of the cam 68 is controlled by a pneumatic fluid cylinder 75 (FIGS. 1–3) which includes a cylindrical housing 76 having a projection 77 secured by a pivot pin 78 between a pair of flanges 80,81 (FIG. 2) which are in turn secured by bolts 82 (FIG. 1) to an angle iron or plate 83 which is in turn welded or otherwise secured to a plate 84. Upper and lower pieces of angle iron 85,86 reinforce the plate 84 at the end thereof adjacent the flanges 80,81.

The plate 84 is secured by bolts 87 to a generally L-shaped plate, as is viewed in side elevation in FIG. 1, having a leg 88 secured by bolts 90 to the plate 13. The leftmost end (unnumbered) of the plate 84 has secured thereto a block 91 by means of nuts and bolts 92 (FIG. 3). The block 91 includes a cylindrical bore (unnumbered) which receives the cam 68 and serves as a trunnion therefor, while a similar block 93 remote from the block 91 likewise has a bore (unnumbered) for receiving the cam 68 with the block 93 being similarly bolted (not shown) to the plate 12 (FIG. 3). A piston (not shown) within the cylinder 76 is connected to a reciprocal piston rod 94 which in turn carries a link 95 joined by a pivot pin 96 to another link 98 which is in turn fastened to the cam 68 by bolt 100 in the conventional manner illustrated in FIG. 1. The cylinder 76 includes suitable ports for introducing hydraulic or pneumatic media thereinto at the rod and head ends of the unillustrated piston. When the media is introduced into the head end of the cylinder 76, the rod 94 is moved outwardly of the cylinder 76 to the left as viewed in FIG. 1, which rocks the cam 68 in a counterclockwise direction, as viewed in FIGS. 1 and 4. During this motion the end 67 of each thumbscrew 62 moves from the cylindrical portion 70 of the cam 68 and against the flat cam surface 71 thereof, resulting in the arms 52 being pivoted clockwise, as viewed in FIG. 4, thereby increasing the size of the gap G. This increased size is maintained momentarily and for a sufficient time period for the particles to exit through the gap G in the manner heretofore described. Thereafter, hydraulic or pneumatic fluid is introduced into the cylinder 76 at the rod end thereof resulting in the retraction of the piston rod 94 into the cylinder 76 which is a left-to-right motion as viewed in FIG. 1, resulting in the clockwise rocking of the cam 68 and the return of each of the ends 67 of the thumbscrews 62 from the flattened cam portion 71 to the cylindrical cam portion 70 thereby returning the gap G to its minimum original predetermined size (FIG. 4). In this fashion the doctor blade 35 may be momentarily deflected to increase the gap G and return the same to the original size at any time during the operation of the apparatus 10, as dictated by the quality (presence or absence of particles or like contaminants) of the coating material L.

The overall apparatus 10 is mounted relative to the transfer roll 17 by means of a mounting plate 105 (FIG. 1) secured by bolts 106 to the plate 13, as well as identical structure secured to the plate 12. Each of the mounting plates 105 includes an oval-shaped aperture 107 through which passes a support rod 108 fixed to a frame (not shown) of the associated structure. The oval shape of the aperture 107 permits the container 10 to be shifted slightly toward or away from the transfer roll 17 and suitably locked in any selected position to properly position the plates 27, 32, and 35 as desired relative to the surface 16 of the transfer roll 17.

The particular predetermined size of the gap G may be, of course, altered by adjusting the thumbscrews 62 and locking the same in a desired position by the locknuts 66. The "predetermined " size of the gap G is considered that size as measured by the minimum distance between the lowermost edge of the doctor blade 35 and the surface 16 of the transfer roll 17 when the end 67 of each of the thumbscrews 62 are in contact with the cylindrical cam surface 70 of the cam 68.

We claim:

1. Apparatus for periodically purging contaminants from a coating liquid during a coating operation comprising a container for housing a coating liquid, said container including an opening, a rotatable transfer roll contiguous said opening upon a surface of which the coating liquid is deposited, an elongated doctor blade having a free terminal edge, the longitudinal axis of said doctor blade being disposed generally parallel to the axis of rotation of said transfer roll, said doctor blade edge and transfer roll surface defining an exit gap of a predetermined size whereby the deposited coating liquid is doctored to a desired thickness during the passage of said transfer roll surface past doctor blade edge, means for rotating said transfer roll to move said transfer roll surface past said doctor blade edge, means for periodically increasing the predetermined size of said gap and returning the increased gap size to the predetermined size whereby contaminants otherwise incapable of passing through said gap when of said predetermined size will pass through said gap when of said increased size, means for selectively adjusting the predetermined size of said gap, said gap size increasing means includes means for effecting movement of said free terminal edge away from said transfer roll surface to produce said increased gap size, said movement effecting means including pivotally mounted arm means having opposite ends, one of said arm means ends being in contact with said doctor blade, movable cam means operative through another of said arm means ends to pivot said arm means for varying the size of said gap upon deflection of said doctor blade and said gap adjusting means is carried by said one arm means opposite end.

2. The apparatus as defined in claim 1 wherein said gap adjusting means is thumbscrew means threadably carried by said one arm means opposite end, and said thumbscrew means is in contact with said cam means.

3. The apparatus as defined in claim 1 including means for biasing said one arm means opposite end toward said cam means, said gap adjusting means is thumbscrew means threadably carried by said one arm means opposite end, and said thumbscrew means is in contact with said cam means.

4. The apparatus as defined in claim 3, including fluid motor means for oppositely reciprocally rotating said cam means.

* * * * *